US005082703A

United States Patent [19]

Longobardi

[11] Patent Number: 5,082,703

[45] **Date of Patent: * Jan. 21, 1992**

[54] SIGN WITH TRANSPARENT SUBSTRATE

[76] Inventor: Lawrence J. Longobardi, 609 Melba, Encinitas, Calif. 92024

[ * ] Notice: The portion of the term of this patent subsequent to Jun. 12, 2007 has been disclaimed.

[21] Appl. No.: 528,701

[22] Filed: May 24, 1990

Related U.S. Application Data

[63] Continuation-in-part of Ser. No. 291,538, Dec. 28, 1988, Pat. No. 4,933,218.

[51] Int. Cl.[5] ..... B44F 1/06

[52] U.S. Cl. ..... 428/38; 40/615; 427/266

[58] Field of Search ..... 40/615; 427/266; 428/38

[56] References Cited

U.S. PATENT DOCUMENTS 3,900,641 8/1975 Woodman et al. ..... 428/38
3,931,425 1/1976 Kuroda ..... 428/38
4,127,689 11/1978 Holt ..... 428/38
4,500,374 2/1985 Nakazima ..... 40/615 X
4,721,635 1/1988 Helinski ..... 428/203 X
4,791,010 12/1988 Hanley et al. ..... 428/38 X
4,933,218 6/1990 Longobardi ..... 428/38
4,952,462 8/1990 Bright ..... 428/542.2
5,010,672 4/1991 Coleman ..... 40/615

*Primary Examiner*—Henry F. Epstein
*Attorney, Agent, or Firm*—Nydegger & Associates

[57] ABSTRACT

A sign with an etched or embossed appearance comprises a transparent substrate on which an extraordinarily thick ridge of viscous ink has been deposited to form a design. For an embossed appearance, the ridge of ink is uniformly smooth. For an etched appearance, the ridge of ink is formed with a textured pattern. A sheet having a thin layer of adhesive on one side is pressed onto the substrate over the ridge of ink to adhear the sheet to the substrate and conform the sheet to the ridge to give the appropriate appearance for the design. Alternatively, the sheet may be replaced by a solidified stratum of a metallic-based solution or powder which may be sprayed or electroplated, respectively, onto the substrate.

30 Claims, 1 Drawing Sheet

SIGN WITH TRANSPARENT SUBSTRATE

FIELD OF THE INVENTION

This application is a continuation-in-part of co-pending patent application Ser. No. 291,538 filed Dec. 28, 1988 now U.S. Pat. No. 4,933,218. This invention relates generally to signs. More specifically, the present invention relates to signs which portray a threedimensional effect. The present invention is particularly, but not exclusively, useful for signs which give an appearance of being etched or embossed.

BACKGROUND OF THE INVENTION

Through the years, signs have been made and used for numerous diverse purposes. Furthermore, the many designs which can be used in a sign and the countless ways in which its message can be expressed are limited only by the imagination and skill of the sign maker. On the other hand, the actual structure of a particular sign, and the methods by which it can be made are not so numerous. In their most basic structure, signs comprise a substrate on which a message is painted, carved, formed or otherwise placed. In some situations, in order to be really effective, a sign should do more than merely communicate a message. It needs to be ornamental and have some aesthetic appeal.

One popular form of sign which is frequently used for advertising incorporates a transparent substrate (e.g. glass) on which messages and designs are placed. With glass substrates, an etching process is sometimes used to provide a special aesthetic effect for the sign. As is well known in the pertinent art, etching can be accomplished by using an acid to cut or corrode selected areas of the glass substrate. The process requires several steps and can be relatively expensive.

Another effect used in the manufacture of signs to add some aesthetic appeal is embossing. Like etching, embossing is also well known in the art. More specifically, embossing is used whenever a portion of the surface of a sheet is to be raised or bulged to represent relief. Often times, glass is used as a superstrate for an embossed sheet to protect and support the sheet.

Both etching and embossing are widely used and are each effective in providing unique aspects for a distinctive sign which add aesthetic appeal. Importantly, etched or embossed products result from the practice of distinctly different and essentially incompatible processes. The present invention, however, recognizes that an essentially same process can be used to manufacture a sign which gives the appearance of incorporating either etched glass or an embossed sheet.

In light of the above, it is an object of the present invention to provide a sign which gives the appearance that it incorporates etched glass. It is another object of the present invention to provide a sign which gives the appearance that it incorporates an embossed sheet. Still another object of the present invention is to provide a method for manufacturing signs which can give the appearance of incorporating either etched glass or an embossed sheet. Yet another object of the present invention is to provide a sign, and its method of manufacture which are respectively easy to use and to practice and which are cost effective for their intended purposes.

SUMMARY OF THE INVENTION

A preferred embodiment of the novel sign with transparent substrate comprises an extraordinarily thick ridge or layer of viscous ink which is deposited on a surface of the substrate to establish the outline of an intended design. Specifically, a ridge of ink may be used to outline the design or the entire design can be a continuous layer of ink. The ink ridge may be either uniformly smooth or have a textured pattern depending on whether the desired aesthetic effect for the design is to give the appearance of embossing or etching. Likewise, the ink layer may be uniformly smooth or selectively textured for similar effects. Further, the ink used for the extraordinarily thick ridge or the extraordinarily thick layer may be either clear or tinted.

Prior to depositing the ink ridge on the substrate, a relatively thin layer of tinted ink, rather than the extraordinarily thick layer of ink, may be placed on portions of the substrate and used to establish the desired design. The ink ridge can then be deposited on the substrate to overlap selected portions of the edge of the design.

A sheet or foil having a thin transparent adhesive on one side is pressed onto the surface of the substrate with the ink ridge positioned between the sheet and the substrate. Importantly, the sheet or foil conforms to the ink ridge and adheres to the surface of the substrate to form the structure for the sign. In an alternate embodiment, the sheet is not used and instead, a silver or plastic powder solution is sprayed or electroplated onto the substrate. The solution subsequently solidifies and may then be covered with a protective layer.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
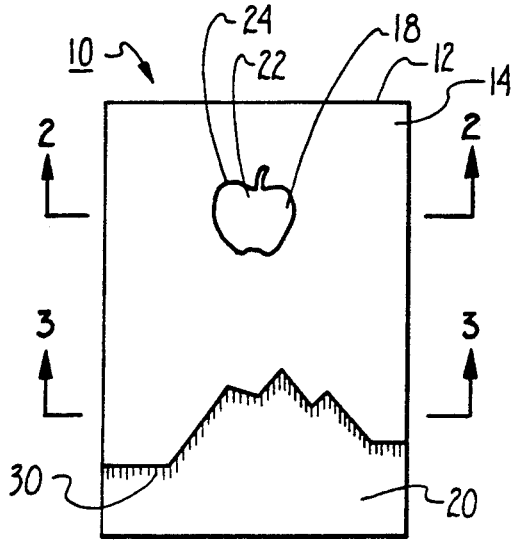
FIG. 1 is a front elevation view of a sign.

Referring initially to FIG. 1, a sign is shown and generally designated 10. As seen in FIG. 1, sign 10 comprises a substrate 12 which can be made of any transparent material well known in the art, such as glass or plastic. Further, substrate 12 can be either clear or color tinted. For purposes of the present invention, substrate 12 is perferably formed as a sheet or layer of transparent material which presents its top surface 14 as the front of sign 10. Accordingly, as best seen in FIGS.

2 and 3, substrate 12 also has a bottom surface 16 which is opposite the top surface 14.

Figure 2:
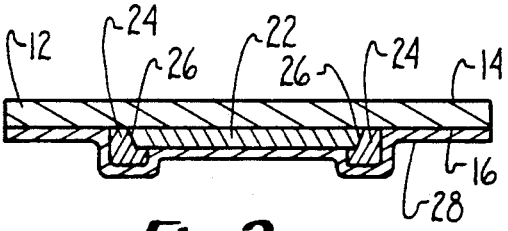
FIG. 2 is a cross-sectional view of the sign as seen along the line 2—2 in FIG. 1.
Figure 3:
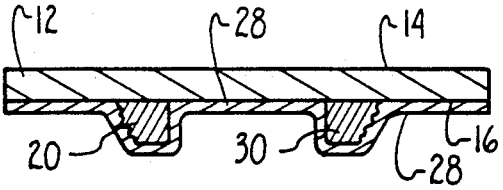
FIG. 3 is a cross-sectional view of the sign as seen along the line 3—3 in FIG. 1.
Figure 4:
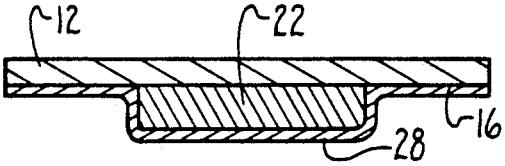
FIG. 4 is a cross-sectional view of an alternate embodiment of the sign as seen along the line 2—2 in FIG. 1.

By cross referencing FIG. 1 with FIGS. 2, 3 and 4, it will be appreciated that designs can be placed on bottom surface 16 in any shape or form according to the desires of the sign maker. The apple design 18 and mountain design 20 shown in FIG. 1 are only exemplary. More particularly, by cross referencing FIG. 1 with FIG. 2, it can be appreciated that design 18 is created by placing a relatively thin ink layer 22 on bottom surface 16 of substrate 12 in the desired shape (e.g. apple). An extraordinarily thick ridge of ink 24 is also deposited on surface 16 to overlap edge 26 of ink layer 22.

In accordance with the present invention, the ink which is used for both layer 22 and ridge 24 is relatively viscous and is curable within a relatively short period of time (e.g. six seconds). More specifically, it is preferred that the ink be curable with ultraviolet (UV) light. Further, the ink should be relatively viscous, such as any of the enamel, epoxy and acrylic inks which are well known in the art. Also, it is to be appreciated that the ink can be selectively either clear or tinted. For example, ink layer 22 of design 18 can be colored and ink ridge 24 of design 18 can be clear.

Importantly, ridge 24 must be exceptionally or extraordinarily thick. For the purposes of the present invention, ink ridge 24 should be greater than approximately five one-hundredths (0.05) of an inch in thickness. It is to be understood, however, that this thickness can be varied and be thicker or thinner according to the desired visibility of the effect. Generally, when using the well known silk screen process to deposit ink ridge 24 on surface 16, a sixty (60) line per inch mesh will accomplish the desired result. It will be appreciated that this mesh can be used whenever an extraordinarily thick deposit of ink is required. Unlike ridge 24, ink layer 22 can be relatively thin. Indeed, ink layer 22 may be as thin as approximately one thousandth (0.001) of an inch. This result can be achieved by a silk screening process using a mesh which has approximately three hundred (300) lines per inch. On the other hand, by referring for the moment to FIG. 4, it will be seen that the entire layer 22 may be extraordinarily thick. Thus, apple design 18 can be uniformly raised.

As best seen in FIG. 2, after ink layer 22 and ink ridge 24 have been deposited on surface 16 to form design 18 and the inks have been properly cured, a sheet 28 is attached to the surface 16 with design 18 between sheet 28 and surface 16. It will be appreciated that sheet 28 may be made of any suitable material such as paper, plastic or metal foil. Furthermore, the surface of sheet 28 which adheres to surface 16 and design 18 may be a reflective material, in order to highlight the design. Importantly, however, sheet 28 must have a thin transparent adhesive on one of its sides which will adhere to both surface 16 and design 18, and sheet 28 should be sufficiently pliant to conform to the contours created by ink ridge 24. As will be appreciated by the skilled artisan, a roller (not shown) may be used to press sheet 28 against substrate 12 to fill in the crevices created on surface 16 by ink layer 22 and ink ridge 24. Additionally, substrate 12 or sheet 28 may be heated to facilitate this process. Alternately, sheet 28 may be adhered to surface 16 and design 18 by other means well known in the art, such as by vacuum pressing sheet 28 onto surface 16 and design 18.

In FIG. 3, it can be seen that ink layer 22 can be eliminated. As shown, design 20 is created only by outlining the desired design configuration with an ink ridge 30. Consequently, any color which is to be given design 20 will either be from sheet 28 or from the tint used in substrate 12.

Figure 5:
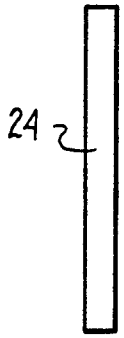
FIG. 5 is a front elevation view of the top of an ink ridge.
Figure 6:
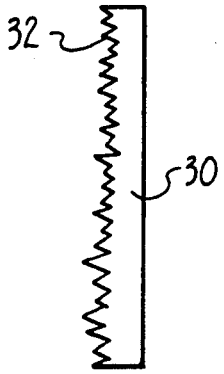
FIG. 6 is a front elevation view of the top of an alternate embodiment of an ink ridge.

Referring now to FIGS. 5 and 6, it is to be seen that ink ridges for the present invention can be of several configurations. The specific configuration used will depend on the particular aesthetic effect which is desired. It can be appreciated from FIG. 5 that ink ridge 24 is formed to be uniform and smooth. Such a configuration as that shown for ink ridge 24 is used to create the appearance the design is embossed. Specifically, in line with the disclosure herein, design 18 on sign 10 would appear to be an embossed apple. A smooth and uniform ink ridge (e.g. ink ridge 24) will also give the appearance that edge 26 of ink layer 22 is beveled or raised.

To obtain a different aesthetic effect, an ink ridge 30 formed with a textured pattern 32 may be used. Specifically, a pattern 32, such as the one shown for ink ridge 30, in FIG. 6, will give the appearance that surface 16 of substrate 12 has been etched. It is to be appreciated that pattern 32 is only exemplary and that other patterns may be used for this purpose within the intent of the present invention.

In accordance with the present invention, the manufacture of sign 10 is accomplished by first depositing an extraordinarily thick ridge or layer of a viscous ultraviolet curable ink on surface 16 of transparent substrate 12 in the desired design. If the intent is to establish a design having the appearance of being embossed, an extraordinarily thick ink ridge 24 or ink layer 22 which is uniformly smooth is deposited on surface 16 of substrate 12. On the other hand, if the desire is to give an appearance of etching, a ink ridge 30 having a pattern 32 is deposited on surface 16 of substrate 12. Similarly, edge 26 of an extraordinarily thick layer 22 may be formed with a pattern 32 to give the appearance of etching.

The method for depositing ink layer 22, ink ridge 24 or ink ridge 30 on substrate 12 is preferably by silk screening. With silk screening, an extraordinarily thick layer, or ridge, or ink can be deposited on substrate 12 using a mesh screen having approximately sixty (60) lines per inch. The extraordinarily thick ridge or layer of ink is then subjected to UV radiation for approximately six (6) seconds for the purpose of curing the ink.

A thin layer of UV curable ink, rather than an extraordinarily thick layer, may be placed in the basic shape of the desired design prior to depositing the extraordinarily thick ink ridge 24 on substrate 12. This thin layer 22 of ink can be applied using the same silk screening technique as mentioned above. For the thin layer, however, a mesh of three hundred (300) lines per inch is perhaps more appropriate. If a thin layer 22 is applied, layer 22 would be subjected to UV light for the curing process prior to depositing ink ridge 24 or ink ridge 30 at the edge of the established design.

Once the inks have been cured, a sheet 28 having a thin transparent adhesive on one side thereof is pressed against substrate 12 with the UV curable inks between substrate 12 and sheet 28. This pressing procedure may be accomplished by using a roller or vacuum press to ensure that sheet 28 fills in all the crevices that have been created on surface 16 of substrate 12 by the deposit of inks thereon. Further, the pressing procedure is accomplished to conform the sheet 28 with the ink deposits To facilitate the process, substrate 12 or sheet 28, or both, may be heated.

Figure 7:
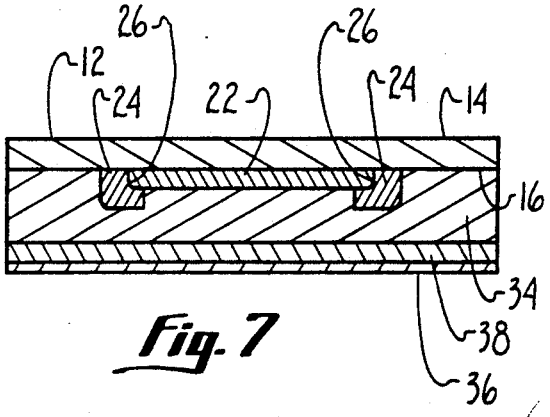
FIG. 7 is a cross-sectional view of an alternate embodiment of the sign as seen along the line 2—2 in FIG. 1.

In the alternate embodiment shown in FIG. 7, no sheet 28 is used. Instead, a stratum 34 is deposited onto surface 16, ink layer 22, and ink ridge 24 by any well-known means, such as by spraying a solution onto surface 16, ink layer 22, and ink ridge 24 which subsequently solidifies into stratum 34. This solution may comprise any appropriate reflective solution, such as a silver or gold-based solution. Alternatively, stratum 34 may be deposited onto surface 16, ink layer 22, and ink ridge 24 by electroplating an appropriate dry reflective powder, such as an aluminum-based powder, onto surface 16, ink layer 22, and ink ridge 24. While stratum 34 may be deposited over surface 16, ink layer 22, and ink ridge 24 for ease of manufacturing, it is not necessary that stratum 34 cover ink layer 22 and ink ridge 24. Thus, it is to be understood that stratum 34 may cover only surface 16. Accordingly, stratum 34 may initially be deposited only onto surface 16, or deposited onto surface 16, ink layer 22, and ink ridge 24 and then removed, if desired, from ink layer 22 and ink ridge 24. In either case, stratum 34 may be covered with a protective layer 36 of paint to minimize cracking and peeling of stratum 34. To further protect stratum 34, a protective substrate 38, such as a copper foil or sheet, may be disposed between stratum 34 and paint layer 36.

Color for the various structural components of the sign may be provided in any of several ways. First, the inks themselves may be clear or tinted. Likewise, transparent substrate 12 may be clear or tinted. Furthermore, sheet 28 may be colored. Obviously, the various color combinations and permutations which are possible with the present invention depend on only the imagination of the sign maker.

While the particular sign with transparent substrate as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A sign which comprises:
a transparent substrate having a surface;
a layer of ink applied on said surface in a design having an edge;
an extraordinarily thick ridge of ink applied on said surface at the edge of said design; and
a stratum deposited on said surface and adhered thereto.

2. A sign as recited in claim 1 wherein said surface of said substrate is flat.

3. A sign as recited in claim 1 wherein said substrate is clear glass.

4. A sign as recited in claim 1 wherein said ridge of ink overlaps said edge of said design.

5. A sign as recited in claim 1 wherein said ridge of ink is textured.

6. A sign as recited in claim 1 wherein said ink for said layer and for said ridge is curable with ultraviolet radiation.

7. A sign as recited in claim 1 wherein said stratum comprises a solidified layer of a silver-based liquid solution for adhering to said surface.

8. A sign as recited in claim 7 wherein said solution is sprayed onto said surface.

9. A sign as recited in claim 1 wherein said stratum comprises a solidified stratum of a dry powder for adhering to said surface.

10. A sign as recited in claim 9 wherein said powder is electroplated onto said surface.

11. A sign as recited in claim 1 wherein said stratum is reflective.

12. A sign as recited in claim 1 further comprising a layer of paint coating said deposited stratum opposite said surface.

13. A sign as recited in claim 12 further comprising a copper sheet disposed between said layer of paint and said deposited stratum.

14. A sign which comprises:
a transparent substrate having a surface;
an extraordinarily thick ridge of ink at the edge of a layer of ink applied to said surface in a design; and
a reflective stratum conformable with said ink design, and adhered to said surface.

15. A sign as recited in claim 14 wherein said substrate is glass.

16. A sign as recited in claim 14 wherein said substrate is flat.

17. A sign as recited in claim 14 wherein said ink is clear.

18. A sign as recited in claim 14 wherein said ink is colored.

19. A sign as recited in claim 14 wherein said design has an edge and said edge is textured.

20. A sign as recited in claim 14 wherein said ink is curable with ultraviolet radiation.

21. A sign as recited in claim 14 wherein said stratum comprises a solidified stratum of a silver-based liquid solution for adhering to said surface.

22. A sign as recited in claim 21 wherein said solution is sprayed onto said surface.

23. A sign as recited in claim 14 wherein said stratum comprises a solidified layer of a dry powder for adhering to said surface.

24. A sign as recited in claim 23 wherein said powder is electroplated onto said surface.

25. A sign as recited in claim 14 further comprising a layer of paint coating said deposited stratum opposite said surface.

26. A sign as recited in claim 25 further comprising a copper sheet disposed between said layer of paint and said deposited stratum.

27. A method for manufacturing a glass sign which comprises the steps of:
depositing an extraordinarily thick ink ridge on a surface of a glass substrate in a preselected design about a thin ink layer;
curing the ink ridge; and
depositing a stratum onto the surface of the substrate to conform the stratum to the surface of the substrate and ink design and to adhere the stratum to the substrate.

28. A method for manufacturing a glass sign as recited in claim 27 further comprising the steps of:
applying an ink layer on said substrate to form a design having an edge;
depositing said ink ridge on said substrate to overlap said edge;
curing the ink ridge; and
solidifying said stratum to adhere said stratum to the surface of the substrate during said depositing step.

29. A method for manufacturing a glass sign as recited in claim 27 wherein said stratum is a solidified layer of a metallic-based solution, said solution being sprayed onto said surface of said substrate to accomplish said stratum depositing step.

30. A method for manufacturing a glass sign as recited in claim 27 wherein said stratum is a solidified layer of a powder, said powder being electroplated onto said surface of said substrate to accomplish said stratum depositing step.

* * * * *